313-414 SR
1/8/85 OR 4,492,894

United States Patent [19]
Reule et al.

[11] Patent Number: 4,492,894
[45] Date of Patent: Jan. 8, 1985

[54] ELECTRON-BEAM FORMING SYSTEM FOR MULTI-BEAM CATHODE-RAY TUBES

[75] Inventors: Hans Reule, Wendlingen; Hartmut Ganzle, Plochingen; Horst H. Vogel, Denkendorf, all of Fed. Rep. of Germany

[73] Assignee: International Standard Electric Corporation, New York, N.Y.

[21] Appl. No.: 542,090

[22] Filed: Oct. 17, 1983

Related U.S. Application Data

[63] Continuation of Ser. No. 429,572, Sep. 30, 1982, abandoned, which is a continuation of Ser. No. 149,102, May 12, 1980, abandoned.

[30] Foreign Application Priority Data

May 18, 1979 [DE] Fed. Rep. of Germany ..... 2920151

[51] Int. Cl.[3] ..... H01J 29/50; H01J 29/82

[52] U.S. Cl. ..... 313/414; 313/417; 313/457

[58] Field of Search ..... 313/414, 417, 457

[56] References Cited

U.S. PATENT DOCUMENTS 3,974,416 8/1976 Van der Goot et al. ..... 313/417
4,119,884 10/1978 Blumenberg et al. ..... 313/414 X
4,138,624 2/1979 Srowig ..... 313/417

*Primary Examiner*—Palmer Demeo
*Attorney, Agent, or Firm*—John T. O'Halloran; Alfred C. Hill

[57] ABSTRACT

The electrodes of an electron-gun system of a color-picture tube are heated less as their distance from the cathode of the system increases. The electrode materials are so chosen with respect to their coefficients of expansion that no mechanical stresses are caused in the system structure despite the different temperatures.

5 Claims, 4 Drawing Figures

ELECTRON-BEAM FORMING SYSTEM FOR MULTI-BEAM CATHODE-RAY TUBES

CROSS REFERENCE TO RELATED APPLICATION

This application is a continuation of application of Ser. No. 429,572, filed Sept. 30, 1982, now abandoned, which is a continuation application of Ser. No. 149,102 filed May 12, 1980, now abandoned.

The present invention relates to electron-beam forming systems for multi-beam cathode-ray tubes, and particularly color-picture tubes, comprising cathodes followed by electrodes acting on the electron beams. The electrodes are disposed in planes lying one behind the other. During operation, the electrodes are heated to different temperatures due to their proximity to the cathodes, with the temperatures increasing with decreased distance from the cathodes.

Since the electrodes of such systems are heated to different temperatures, stresses are caused in the system, which greatly affect the cathode current or the convergence characteristics of the tube, for example. In the prior German DE-OS No. 26 42 582, it is pointed out that it is advantageous to reduce the stresses by reducing the thermal expansion of the components of the individual grid planes and making it approximately equal in magnitude.

The prior DE-OS proposes to make the control grid cylinder and its supports of a material with very small thermal expansion. At the operating temperature of the grid cylinder, the material must not be magnetic.

It has turned out that it is very difficult to reduce the expansion of the components of the grid planes and make it approximately equal in magnitude if the material is to be nonmagnetic. Commercially available alloys with small thermal expansion are almost all still magnetic at the operating temperatures of the electrodes.

The object of the invention is to improve an electron beam-forming system for multi-beam cathode-ray tubes in such a way that no mechanical stresses are caused by thermal expansion. This is accomplished without the need to meet the requirement for negligible thermal expansion and without the electron beams being influenced by the magnetic properties of the electrodes at the operating temperature.

This object is achieved by selecting electrode materials having coefficients of thermal expansion so that the ratio of the difference in linear thermal expansion between every two adjacent electrodes to the distance between the electrode planes is approximately constant over the entire electrode system. With this solution it is no longer necessary to use a material with very small thermal expansion, so that a considerably greater number of materials can be employed.

Embodiments of the invention will now be explained in more detail with reference to the accompanying drawings, in which.

(a) All electrodes made of the same material, as in the prior art systems (b) Grid cylinder made of FeNi 36, as proposed in DE-OS No. 26 42 582

(c) Structure according to the invention.

Figure 1:
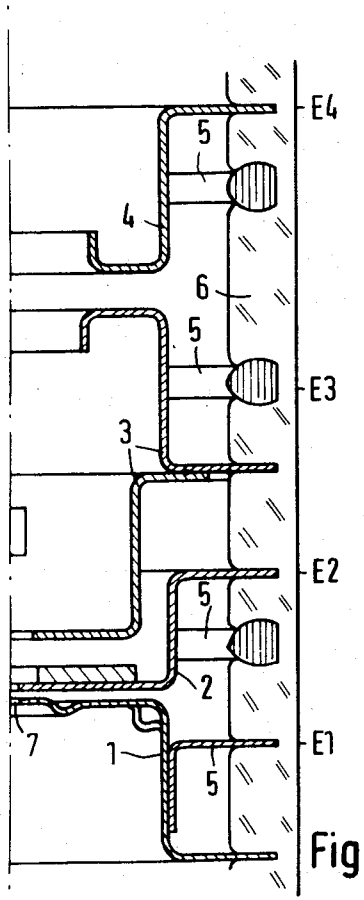
FIG. 1 shows a longitudinal cross section through an electron-beam forming system.

FIG. 1 shows a longitudinal section through an in-line system with three electron guns arranged side by side, whose electrodes lie in four planes E1 to E4 disposed one behind the other along the longitudinal axis. It should be noted that the sectional area was chosen so that glass beads and support elements of the electrodes were cut, too. The electrodes 1 to 4 are sealed in the glass beads 6 either directly or via support elements 5. In each electrode, three apertures 7 are provided for the electron beams. In FIG. 1, these apertures are located side by side along a line perpendicular to the cutting plane of the FIG. 1 section, so that only the one in the middle can be seen.

The spacing between the apertures is 6.6 mm.

The change in the center-to-center spacing of the apertures at different temperatures is considered to be a measure of the linear thermal expansion of an active plane.

During operation, the electrodes heat up to different temperatures. This is shown for the four planes in the Table below. The time t is the time after the heater is turned on.

| | t = 0 | t = 4 min | t = 12 min | t = ∞ |
|---|---|---|---|---|
| E1 | 25° C. | 255° C. | 305° C. | 315° C. |
| E2 | 25° C. | 58° C. | 125° C. | 155° C. |
| E3 | 25° C. | 38° C. | 85° C. | 119° C. |
| E4 | 25° C. | 33° C. | 61° C. | 91° C. |

Figure 3:
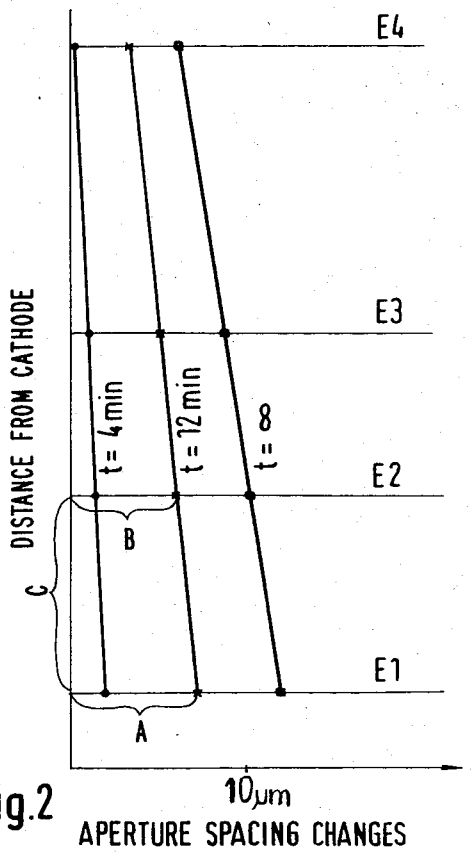
FIG. 3 shows the expansion of the various electrode planes in a system according to the invention.
Figure 2:
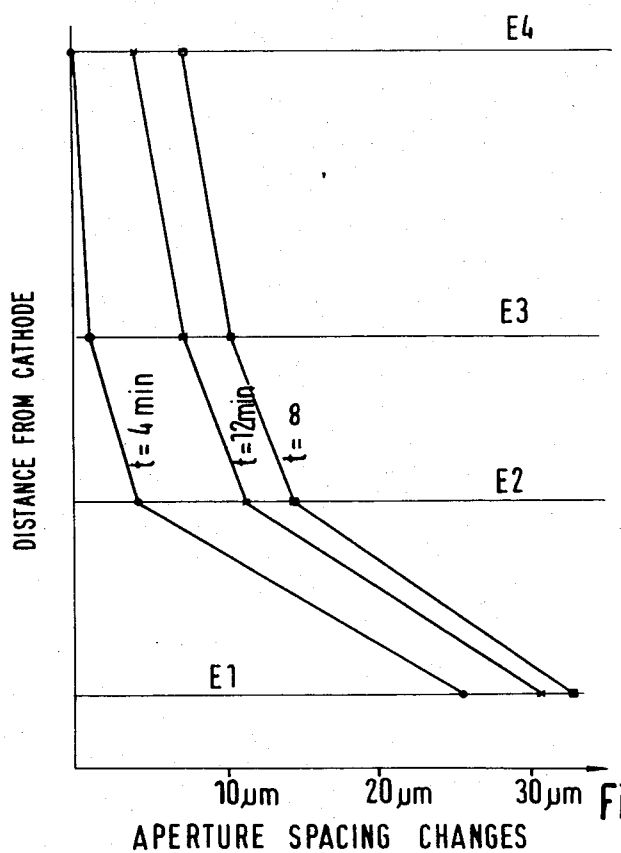
FIG. 2 shows the expansion of the various electrode planes in a known system.

As the temperature increases, the aperture spacing within an active plane changes due to the thermal expansion of the electrode materials. In FIG. 2, this change in aperture spacing is plotted for the three times t=4 min, 12 min, and in the final state ∞ against the distance between the cathode and the respective electrode plane. It can be clearly seen that the ratio of the distance between two electrode planes to the difference in the thermal expansion of the components of these two electrode planes is not constant. This results in great stresses in the system. According to the invention, these stresses are avoided if the above ratio remains constant, as shown in FIG. 3 where A−B equals the difference in aperture spacing change between the electrodes in planes E1 and E2 and C is the distance between electrode planes E1 and E2 so that (A−B)/C is constant for each electrode pair at the various transition temperatures and represents the constant slope of the curves shown in FIG. 3. In FIG. 3, the change in aperture spacing is not graduated on purpose in order to indicate that the essential idea consists in the maintenance of the constant ratio rather than in the achievement of very small thermal expansion.

Advantageously, the electrodes of two planes are made of the same material, because fewer materials must be tested and kept in stock than if different electrode materials are used for each plane.

Values as shown in FIG. 2 are obtained if x4CrNi1813 is used. The ratios of FIG. 3 are obtained, i.e. the object of the invention is achieved, to a good approximation if the following materials are used:

For the electrode 1: FeNi36

For the electrode 2: NiFe48Cr

For the electrodes 3 and 4: x4CrNi1813.

If NiFe48Cr is used for the electrode 2, the Curie point of 480° C. will never be exceeded during operation. It has turned out, however, that the magnetic influence of the electrode 2 does not result in any serious imaging errors on the screen. If 30Ni70Fe with a Curie point in the range from 35° to 65° C. is used, difficulties as may be encountered with other electrode structures because of ferromagnetism are avoided. In the electrode structure of FIG. 1, the materials of the electrodes 3 and 4 must exceed the Curie point after a short operating time if imaging errors are to be avoided. The invention applies analogously to system structures other than that shown in FIG. 1, i.e., not only to in-line systems but also to delta-gun and one-beam systems.

A sensitive means of detecting stresses in the system has proved to be the cathode current. The cathode is connected to a voltage of 0 V, and the electrode 1 to −100 V. The positive voltage of the electrodes 2 and 3 is adjusted so that a cathode current of 100 μA flows in the steady state. After this adjustment, the system is allowed to cool off, and the cathode current is measured after the power is turned on again.

Figure 4:
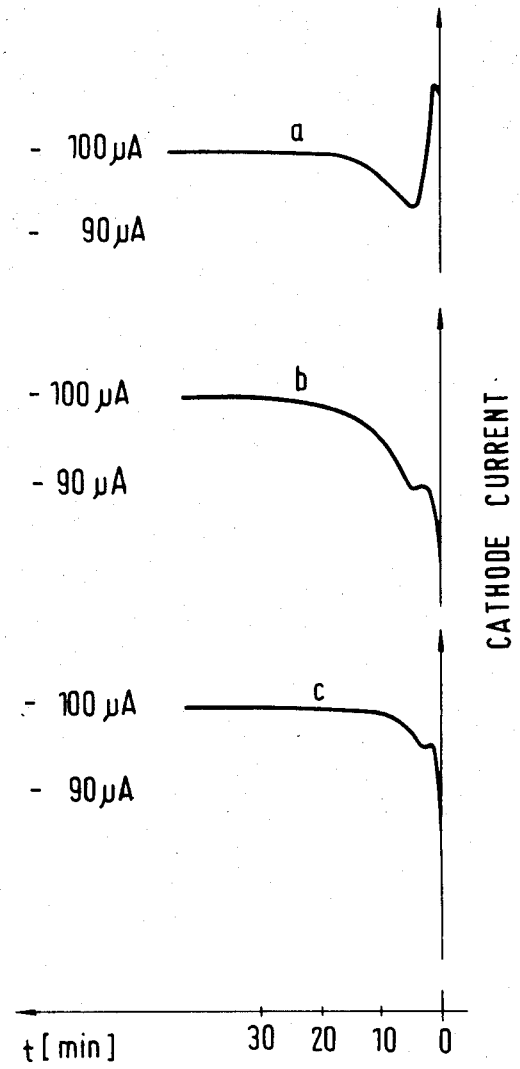
FIG. 4 shows the cathode current in electron-beam forming systems made of different materials.

The results shown in FIG. 4 were obtained with the system structure of FIG. 1. In the case of the curve designated a, all electrodes were made of x4CrNi1813. The cathode current reaches 100 μA after a large overshoot. The curve b was obtained with systems in which the electrode 1 was made of FeNi36. The cathode current rises very slowly to 100 μA. In a system according to the invention, with electrode 1 made of FeNi36, electrode 2 of NiFe48Cr, and electrodes 3 and 4 of x4CrNi1813, the steady state of 100 μA is reached very quickly without overshoot, as shown by curve c.

Compared to known structures, an electron-beam forming system whose electrode-plane materials are matched with respect to thermal expansion according to the invention also permits a considerable reduction of errors caused by a relative displacement of apertures 7 arranged one behind the other in the beam direction, e.g. convergence errors developing in the course of time.

We claim:

1. An electron-beam forming system for multibeam cathode-ray tubes and particularly for color-picture tubes comprising:

a plurality of cathodes for generating a plurality of electron beams; and at least four electrodes for acting on the electron beams, each of said four electrodes being supported from spaced glass beads to dispose each of said four electrodes in different planes lying one behind the other each differently spaced from said plurality of cathodes, each of said four electrodes including a plurality of apertures each aligned with a different one of said plurality of cathodes for passing the electron beam radiating therefrom, at least three of said four electrodes closest to said plurality of cathodes each being formed of different materials each selected to have different coefficients of thermal expansion so that the ratio of the difference in linear thermal expansion between every two adjacent ones of said three electrodes to the distance between the planes of said adjacent ones of said three electrodes is approximately constant whereby mechanical stresses and convergence errors are avoided during operation as said four electrodes are heated to different temperatures depending on their proximity to the cathodes.

2. An electron-beam forming system according to claim 1, wherein two of said four electrodes furthest from said plurality of cathodes are made of the same material.

3. An electron-beam forming system according to claim 2, wherein a first of said four electrodes closest to said plurality of cathodes is formed from FeNi36, a second of said four electrodes next closest to said plurality of cathodes is formed from NiFe48Cr and a third and fourth of said four electrodes furthest from said plurality of cathodes are formed from x4CrNi1813.

4. An electron-beam forming system according to claim 1, wherein a first of said three electrodes closest to said plurality of cathodes is formed from FeNi36, a second of said three electrodes next closest to said plurality of cathodes is formed from NiFe48Cr and a third of said three electrodes furthest from said plurality of cathodes is formed from x4CrNi1813.

5. An electron-beam forming system according to claim 4, wherein a fourth of said four electrodes spaced from said third of said three electrodes remote from said plurality of cathodes is formed from x4CrNi1813.

* * * * *